US006248965B1

(12) United States Patent
Thomas

(10) Patent No.: US 6,248,965 B1
(45) Date of Patent: Jun. 19, 2001

(54) METHODS AND APPARATUS FOR ROLLING CONTACTOR TIPS UPON CLOSURE

(75) Inventor: Sherrill G. Thomas, Chatham, VA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/374,974

(22) Filed: Aug. 16, 1999

(51) Int. Cl.[7] ..... H01H 1/16; H01H 1/20

(52) U.S. Cl. ..... 200/240; 200/241; 200/243; 200/275

(58) Field of Search ..... 200/16 A, 237–245, 200/275, 281

(56) References Cited

U.S. PATENT DOCUMENTS

Re. 33,457 * 11/1990 Ootsuka et al. ..... 200/16 A
2,532,305 * 12/1950 Heller ..... 200/281
3,676,628 * 7/1972 Kane ..... 200/280
3,914,564 * 10/1975 Reed et al. ..... 200/51.1
4,195,212 * 3/1980 Graham et al. ..... 200/243
4,277,662 * 7/1981 Lewandowski ..... 200/243
5,283,406 * 2/1994 Olsen ..... 200/243

* cited by examiner

*Primary Examiner*—J. R. Scott
(74) *Attorney, Agent, or Firm*—Carl B. Horton, Esq.; Damian Wasserbauer, Esq.; Armstrong Teasdale LLP

(57) ABSTRACT

A bus bar assembly includes an elongate body including three unitary portions. A first portion and a third portion are substantially co-planar and a second portion is unitarily offset from the first and third portions. A contactor tip is mounted to a top surface of both the first portion and the third portion. During closure of the bus bar assembly, the offset second portion causes the contactor tips to roll which helps expel contaminants that may have accumulated on the contactor tips.

17 Claims, 1 Drawing Sheet

METHODS AND APPARATUS FOR ROLLING CONTACTOR TIPS UPON CLOSURE

BACKGROUND OF THE INVENTION

This invention relates generally to bus bar assemblies and, more particularly, to a method and apparatus for rolling contactor tips upon closure of a bus bar assembly.

Solid-state control systems typically use microprocessors to control the switching of directional contactors which include contactor tips. Accurately controlling the switching of the directional contactor tips with a microprocessor enhances the performance of the solid-state control systems. Microprocessors effectively switch the directional contactors such that even during opening or closing of the bus bar assembly, little or no current is broken or switched by the directional contactor tips. As a result, little or no arcing of the contactor tips occurs.

Typically, during normal workplace practices, contamination may accumulate on the contactor tips. Additionally, contactor tips are often constructed from metals which facilitate the formation of oxides or sulfides on external surfaces of the metals. Despite the negative effects of arcing, arcing burns away any contamination which may have accumulated on the contactor tips, and as such, improves the performance of the control system. Without arcing or some other cleaning action, the contamination, oxides, or sulfides can quickly accumulate and prevent current from passing into the contactor tips during closure. However, with arcing, the contactor tips can erode and lose effectiveness quickly.

BRIEF SUMMARY OF THE INVENTION

In an exemplary embodiment, a bus bar assembly includes an elongate body which includes three unitary portions. A first and third portion are substantially co-planar and a second portion is unitarily offset from the first and third portions. The first portion and the third portion each include a top surface and a bottom surface connected by a side wall. A contactor tip is mounted to the top surface of both the first portion and the third portion.

In operation, the bus bar assembly is frictionally slid within a relay directional contactor. As the bus bar is moved, the contactor tips are simultaneously moved and are contacted by a second set of contactor tips which extend from the relay directional contactor. Initially the second set of contactor tips extending from the relay directional contactor contacts the contactor tips at an outer edge of each tip. Fully inserting the offset second portion of the bus bar assembly within the relay directional contactor causes the contactor tips to roll. The rolling movement causes the second set of contactor tips extending from the relay directional contactor to traverse across the contactor tips and expel any contaminants that may have accumulated on the contactor tips. As a result, the bus bar assembly eliminates more costly and more time-consuming cleaning methods and provides an assembly that is cost-effective and reliable.

DETAILED DESCRIPTION OF THE INVENTION

Figure 1:
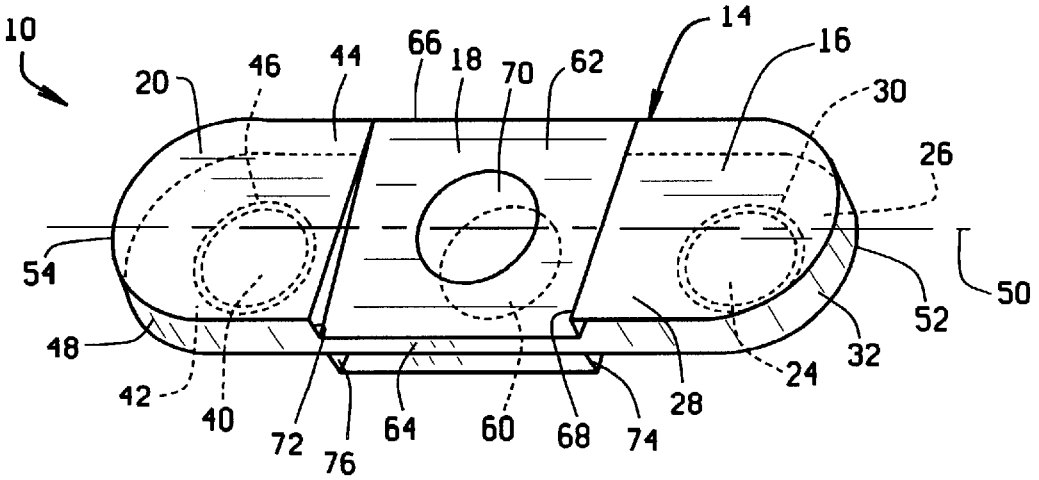
FIG. 1 is perspective view of a bus bar assembly.

FIG. 1 is a perspective view of a bus bar assembly 10 including an elongate body 14 which is substantially flat and unitarily constructed. Elongate body 14 includes a first portion 16, a second portion 18, and a third portion 20 which is substantially co-planar with first portion 16. First portion 16 includes a contactor tip 24, a top surface 26, and a bottom surface 28. Contactor tip 24 includes an outer edge 30 and extends from top surface 26. A side wall 32 connects top surface 26 and bottom surface 28. Top surface 26 and bottom surface 28 are substantially parallel to each other and are substantially flat. First portion 16 has a rectangular cross-sectional profile.

Third portion 20 includes a contactor tip 40, a top surface 42, and a bottom surface 44. Contactor tip 40 includes an outer edge 46 and extends from top surface 42. A side wall 48 connects top surface 42 and bottom surface 44. Top surface 42 and bottom surface 44 are substantially flat and substantially parallel to each other. Third portion top surface 42 is substantially co-planar with first portion top surface 26. Third portion bottom surface 44 is substantially co-planar with first portion bottom surface 28. Third portion 20 has a rectangular cross-sectional profile.

Elongate body 14 includes an axis of symmetry 50 which extends from a first end 52 through first portion 16 and third portion 20 to a second end 54. Contactor tip 24 and contactor tip 40 are positioned symmetrically with respect to axis of symmetry 50. In one embodiment, contactor tips 24 and 40 are manufactured from a silver alloy material composed of approximately 90% silver and 10% cadmium by weight. In another embodiment, elongate body 14 is manufactured from copper.

Second portion 18 includes a top surface 60 and a bottom surface 62. A first side wall 64 and a second side wall 66 connect top surface 60 to bottom surface 62. First side wall 64 and second side wall 66 are substantially parallel to each other. Second side wall 66 is substantially the same thickness as first portion side wall 32 and third portion side wall 48. Second portion 18 has a non-rectangular parallelogram shaped cross-sectional profile. Second portion top surface 60 slopes from first portion 16 top surface 26 and third portion 20 top surface 42. Top surface 60 slopes from first side wall 64 to second side wall 66. Second portion 18 bottom surface 62 slopes from first portion 16 bottom surface 28 and third portion 20 bottom surface 44. Bottom surface 62 slopes from first wall 64 to second wall 66. Second portion 18 also includes an aperture 70 that extends therethrough. Aperture 70 is positioned symmetrically with respect to axis of symmetry 50. A first inward facing wall 68 extends from bottom surface 28 of first portion 16 to bottom surface 62 of second portion 18. A second inward facing wall 72 extends from bottom surface 44 of third portion 20 to bottom surface 62 of second portion 18. A first outward facing wall 74 extends from top surface 26 of first portion 16 to top surface 60 of second portion 18. A second outward facing surface 76 extends from top surface 42 of third portion 20 to top surface 60 of second portion 18.

During closure, bus bar assembly 10 is electrically connected to a relay directional contactor (not shown) such that one or both of contactor tips 24 and 40 electrically engage a set of contactor tips (not shown) attached to the relay directional contactor. As bus bar assembly 10 is electrically connected to the relay directional contactor; contactor tips 24 and 40 are simultaneously electrically connected. As second portion 18 is forced into the relay directional contactor to complete the electrical connection, contactor tips 24 and 40 engage the contactor tips extending from the relay directional contactor. Initially, contactor tip outer edges 30 and 46 are contacted by the contactor tips extending from the relay directional contactor. Because second portion 18 top surface 60 is sloped with respect to first portion top surface 26 and third portion top surface 42, and because second portion bottom surface 62 is sloped with respect to first portion bottom surface 28 and third portion bottom surface 44, second portion 18 is offset from first portion 16 and third portion 20. As such, contactor tips 24 and 40 are rolled as bus assembly 10 is fully inserted into the relay directional contactor during closure. Rolling causes the contactor tips extending from the relay directional contactor and in contact with contactor tips 24 and 40 to traverse across contractor tips 24 and 40 and come to rest during closure. As such, the rolling movement causes the contactor tips extending from the relay directional contactor to help eliminate any contamination that may have developed on contactor tips 24 or 40. Contactor tips 24 and 40 are substantially flat.

Figure 2:
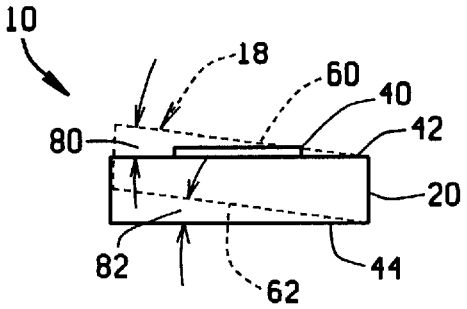
FIG. 2 is a side elevational view of the bus bar assembly shown in FIG. 1.

FIG. 2 is a side elevational view of bus bar assembly 10. Second portion 18 includes top surface 60 and bottom surface 62. Third portion 20 includes top surface 42, bottom surface 44, and contactor tip 40 which is mounted to top surface 42. Contactor tip 40 extends from top surface 42. Second portion top surface 60 slopes from third portion top surface 42 at an angle 80. In one embodiment, angle 80 is approximately 7 degrees. Second portion bottom surface 62 slopes inwardly from third portion bottom surface 44 at an angle 82. In one embodiment, angle 82 is approximately 7 degrees.

The above described bus bar assembly is highly reliable and cost-effective. The assembly includes an elongate body which includes an offset second portion which forces the contactor tips to roll during closure of the bus bar assembly. The rolling movement expels any contaminants that may have accumulated on the contactor tips. Because no additional cleaning methods or arcing are necessary, a cost-effective and reliable bus bar assembly is provided.

While the invention has been described in terms of various specific embodiments, those skilled in the art will recognize that the invention can be practiced with modification within the spirit and scope of the claims.

What is claimed is:

1. A method for rolling contactor tips upon closure of a movable bus bar assembly including a bus bar and at least one contactor tip, the bus bar including an elongate body which includes a first portion having at least one contactor tip, a third portion having at least one contactor tip, and a second portion unitarily extending from the first portion and the third portion, the first portion including a first cross-sectional profile, the second portion including a second cross-sectional profile, the third portion including a third cross-sectional profile, said method comprising the step of:

frictionally sliding the movable bus bar assembly to electrically contact a relay directional contactor such that at least one contactor tip electrically engages a second set of contactor tips extending from the relay directional contactor wherein the second cross-sectional profile is substantially a non-rectangular parallelogram.

2. A method of rolling contactor tips upon closure in accordance with claim 1 wherein the second portion includes a top surface, and a bottom surface said top surface connected to said bottom surface with a first side wall and a second side wall, the first portion first cross-sectional profile is rectangular in shape, and the third portion third cross-sectional profile is rectangular in shape, said method further comprising the step of:

fully inserting the movable bus bar assembly within the relay directional contactor such that at least one contactor tip rolls to rest upon complete closure of the bus bar assembly.

3. A method of rolling contactor tips upon closure in accordance with claim 2 wherein the first portion includes a top surface, a bottom surface, and a side wall which connects the top surface to the bottom surface, the third portion includes a top surface which is substantially co-planar with the first portion top surface and a bottom surface which is substantially co-planar with the first portion bottom surface, and the second portion top surface slopes with respect to the first portion top surface and the third portion top surface.

4. A method of rolling contactor tips upon closure in accordance with claim 3 wherein the second portion bottom surface slopes with respect to the first portion bottom surface and the third portion bottom surface.

5. A method of rolling contactor tips upon closure in accordance with claim 3 wherein the second portion top surface slopes about 7° with respect to the first portion top surface and the third portion top surface.

6. A method of rolling contactor tips upon closure in accordance with claim 4 wherein the second portion bottom surface slopes outward about 7° with respect to the first portion bottom surface and the third portion bottom surface.

7. A bus bar assembly comprising:

an elongate body comprising a first portion, a second portion, and a third portion, said second portion offset from said first portion and said third portion, said third portion co-planar with said first portion, said second portion comprising a substantially non-rectangular parallelogram cross-sectional profile.

8. A bus bar assembly in accordance with claim 7 wherein said first portion comprises a first cross-sectional profile and said third portion comprises a third cross-sectional profile.

9. A bus bar assembly in accordance with claim 7 further comprising a plurality of contactors mounted to said elongate body.

10. A bus bar assembly in accordance with claim 8 wherein said first portion first cross-sectional profile and said third cross-sectional profiles are rectangles.

11. A bus bar assembly in accordance with claim 9 wherein said plurality of contactors comprises a first contactor and a second contactor, said first contactor mounted on said first portion, said second contactor mounted on said second portion.

12. A bus bar assembly in accordance with claim 7 wherein said second portion comprises a top surface and a bottom surface, a first side wall and a second side wall, said first portion comprises a top surface and a bottom surface, said top surface connected to said bottom surface by a side wall, said third portion comprises a top surface substantially co-planar with said first portion top surface and a bottom surface substantially co-planar with said first portion bottom surface.

13. A bus bar assembly comprising:

an elongate body comprising a first portion, a second portion, and a third portion, said second portion offset from said first portion and said third portion, said third portion co-planar with said first portion, said second portion comprises a top surface and a bottom surface, a first side wall and a second side wall, said first portion comprises a top surface and a bottom surface, said top surface connected to said bottom surface by a side wall, said third portion comprises a top surface substantially co-planar with said first portion top surface and a bottom surface substantially co-planar with said first portion bottom surface, said second portion top surface slopes from said second portion second side wall to said second portion first side wall relative to said first portion top surface and said third portion top surface.

14. A bus bar assembly in accordance with claim 13 wherein said second portion bottom surface slopes from said second portion second side wall to said second portion first side wall relative to said first portion bottom surface and said third portion bottom surface.

15. A bus bar assembly in accordance with claim, wherein said second portion top surface has about a 7° slope with respect to said first portion top surface and said third portion top surface.

16. A bus bar assembly in accordance with claim 15 wherein said second portion bottom surface has about a 7° slope with respect to said first portion bottom surface and said third portion bottom surface.

17. A bus bar assembly in accordance with claim 7 further comprising at least one aperture disposed within said second portion and extending from said second portion top surface to said second portion bottom surface.

* * * * *

UNITED STATES PATENT AND TRADEMARK OFFICE

CERTIFICATE OF CORRECTION

PATENT NO. : 6,248,965 B1
DATED : June 19, 2001
INVENTOR(S) : Thomas

It is certified that error appears in the above-identified patent and that said Letters Patent is hereby corrected as shown below:

Column 1,
Line 59, between “is” and “perspective” insert therefor -- a --.

Column 2,
Line 60, delete “;” and insert therefor -- , --.

Column 3,
Line 10, delete “contractor” and insert therefor -- contactor --.

Column 5,
Line 8, after “claim” insert therefor in bolded font -- 14 --.

Column 6,
Line 1, delete “15” and insert therefor in bolded font -- 14 --.

Signed and Sealed this

Fifth Day of August, 2003

JAMES E. ROGAN
*Director of the United States Patent and Trademark Office*